US008127730B2

(12) United States Patent
Bugescu

(10) Patent No.: US 8,127,730 B2
(45) Date of Patent: Mar. 6, 2012

(54) DEVICE FOR COUPLING VALVE ACTIVATING LEVERS OF AN INTERNAL COMBUSTION ENGINE

(75) Inventor: Florin Bugescu, Canton, MI (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 532 days.

(21) Appl. No.: 12/334,694

(22) Filed: Dec. 15, 2008

(65) Prior Publication Data

US 2009/0151668 A1 Jun. 18, 2009

Related U.S. Application Data

(60) Provisional application No. 61/013,430, filed on Dec. 13, 2007.

(51) Int. Cl.
*F01L 1/18* (2006.01)

(52) U.S. Cl. ..... 123/90.39; 123/90.16; 74/559

(58) Field of Classification Search ..... 123/90.15, 123/90.16, 90.39; 74/559, 569
See application file for complete search history.

(56) References Cited

U.S. PATENT DOCUMENTS 4,799,463 A 1/1989 Konno
5,476,075 A 12/1995 Doll et al.
6,343,579 B1 * 2/2002 Yasuyama et al. ..... 123/90.16

FOREIGN PATENT DOCUMENTS

JP 2005018195 7/2005

* cited by examiner

*Primary Examiner* — Zelalem Eshete
(74) *Attorney, Agent, or Firm* — Volpe and Koenig, P.C.

(57) ABSTRACT

Device for coupling two valve activating levers of an internal combustion engine with at least one carrier body (1) mounted on the internal combustion engine, wherein at least one hollow shaft (2) in which oil of the internal combustion engine is stored is attached to the carrier body, and a coupling pin (9) is supported parallel to the hollow shaft (2) in each of the valve activating levers (4*a*, 4*b*) and is spring loaded on one side and loaded by pressurized fluid on the other side in such a way that the coupling pin (9) connects or releases the valve activating levers (4*a*, 4*b*), wherein control of the pressurized fluid that is taken advantageously from the oil circuit of the internal combustion engine is realized by at least one electromagnetically activated valve (14) and wherein the supply of pressurized fluid is realized by channels (13) that are provided in the carrier body (1) or carrier bodies of the internal combustion engine.

7 Claims, 3 Drawing Sheets

DEVICE FOR COUPLING VALVE ACTIVATING LEVERS OF AN INTERNAL COMBUSTION ENGINE

CROSS-REFERENCE TO RELATED APPLICATIONS

This application claims the benefit of U.S. Provisional Appln. No. 61/013,430, filed Dec. 13, 2007, which is incorporated herein by reference as if fully set forth.

FIELD OF THE INVENTION

The invention relates to a device for coupling two valve activating levers of a reciprocating piston internal combustion engine with at least one carrier body that is mounted on the internal combustion engine and on which at least one hollow shaft for supporting the valve activating lever is mounted. Oil of the internal combustion engine is stored in these hollow shafts. The device also has a coupling pin that is supported parallel to the hollow shaft in each of the valve activating levers and that is loaded, on one hand, by a spring and, on the other hand, by pressurized fluid in such a way that the coupling pin connects or releases the valve activating levers with each other, wherein the control of the pressurized fluid that is taken advantageously from the oil circuit of the internal combustion engine is realized by at least one electromagnetically activated valve.

BACKGROUND OF THE INVENTION

Such a class-forming coupling device is known from U.S. Pat. No. 4,799,463. In this device for coupling valve activating levers, the hollow shaft has an intermediate wall in the longitudinal direction, so that two channels are formed in the hollow shaft. One channel is designed for feeding oil that lubricates the bearing of the valve activating lever from the internal combustion engine. This oil supply is optionally also provided for supplying hydraulic valve clearance compensating elements with oil. The second channel is used for controlling the coupling pin between the valve activating levers.

It is easy to see that such a hollow shaft is expensive and complicated in production. Furthermore, this configuration has the effect that only a greater number of coupling pins between several valve activating levers can be simultaneously controlled by an electromagnetically activated valve, because otherwise separating walls extending only perpendicular to the longitudinal axis must be installed or a multiple subdivision must be performed.

U.S. Pat. No. 5,476,075 (equivalent to DE 43 31 504) describes a hollow shaft that has several longitudinal channels and also specifies a method for producing such a hollow shaft.

If the coupling pins are activated, e.g., on both sides by pressurized fluid, then two channels in the hollow shaft are not sufficient.

Japanese Patent Application 2005 180 195 A describes a hollow shaft for supporting valve activating levers, with four longitudinal channels in the hollow shaft.

SUMMARY

The invention is designed to improve and to simplify a device for coupling valve activating levers. In particular, it avoids the requirement that several channels must be formed in the hollow shaft.

This is accomplished in that the supply of pressurized fluid is realized by channels that are provided in the carrier body or the carrier bodies of the internal combustion engine. This configuration separates the supply of pressurized fluid for activating the coupling pin and of oil or pressurized oil for lubricating the valve activating levers or for supplying optionally installed hydraulic valve clearance compensation elements. The supply for lubricating or for supplying pressurized oil for the hydraulic valve clearance compensation elements is realized in a known way through the central hollow shaft without any division, while the supply of pressurized fluid for controlling the coupling pin is realized through oil guidance channels in the carrier body or bodies. The hollow shaft can be produced as a simple tube, while the formation of channels can also be formed, e.g., cast, at least partially during the production of the carrier body easily and economically.

In one preferred configuration of the invention, the carrier body or bodies and one of the valve activating levers in connection with a channel for the pressurized fluid form a transition region at which a guide piece is connected in the valve activating lever to the coupling pin. Therefore, the pressurized fluid can be led from the carrier body into the guide piece of the valve activating lever and from there to the pressure surface of the coupling pin.

Advantageously, the transition region has touching slide surfaces on the carrier body or bodies and the adjacent valve activating lever, wherein this valve activating lever is loaded in the direction of the carrier body, in order to improve the tightness on the sliding surfaces.

Because the valve activating lever pivots about the hollow shaft depending on operation and the carrier body or bodies are fixed in place, it is proposed that in at least one of the sliding surfaces, a kidney-shaped extension is provided in connection with the openings of the channel and/or the guide part. The kidney-shaped extension is extended in the pivoting direction of the valve activating lever, so that a long-lasting connection is given between the channel and the guide part.

Advantageously, the electromagnetically activated valve is arranged in the carrier body, advantageously one valve for each channel. In this way it is achieved that each valve activating lever pair can be controlled arbitrarily. Naturally, if desired, several pairs of valve activating levers can also be controlled simultaneously according to the configuration of channels and the arrangement of the electromagnetically activated valve.

The loading of one valve activating lever in the direction of the carrier body is advantageously realized by a spring.

Advantageously, the spring is formed as a compression spring and is arranged between the second valve activating lever and a wall adjacent to this lever in one or the other carrier body. Here it can involve a simple compression spring that is arranged around the hollow shaft. Especially favorable, however, is a leaf spring that is mounted on the carrier body or an adjacent carrier body, wherein the second valve activating lever contacts the leaf spring with a sliding surface. Lubrication problems are not created because the entire device is housed within a valve cover in which an oil mist is present.

BRIEF DESCRIPTION OF THE DRAWINGS

For further explanation of the invention, refer to the drawings in which an embodiment of the invention is shown simplified. Shown are.

DETAILED DESCRIPTION OF THE PREFERRED EMBODIMENTS

Figure 1:
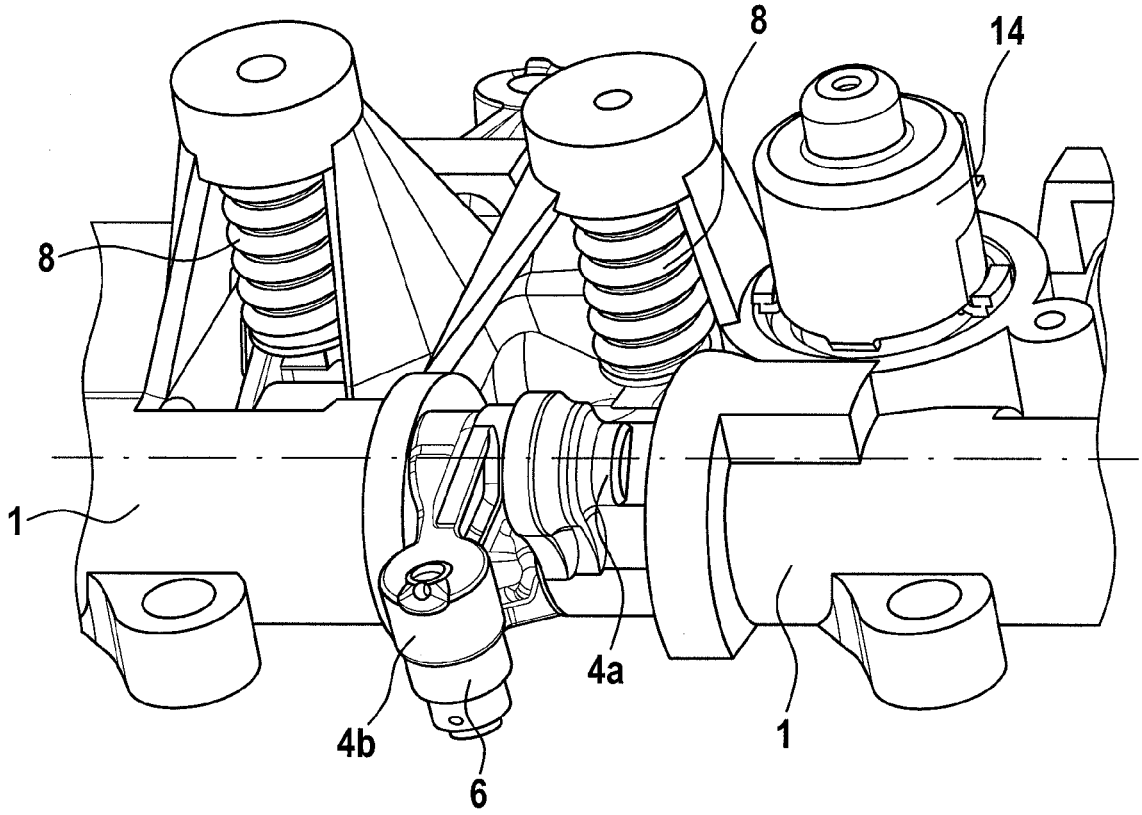
FIG. 1 is a perspective view of a section of a device for activating two gas-exchange valves.
Figure 2:
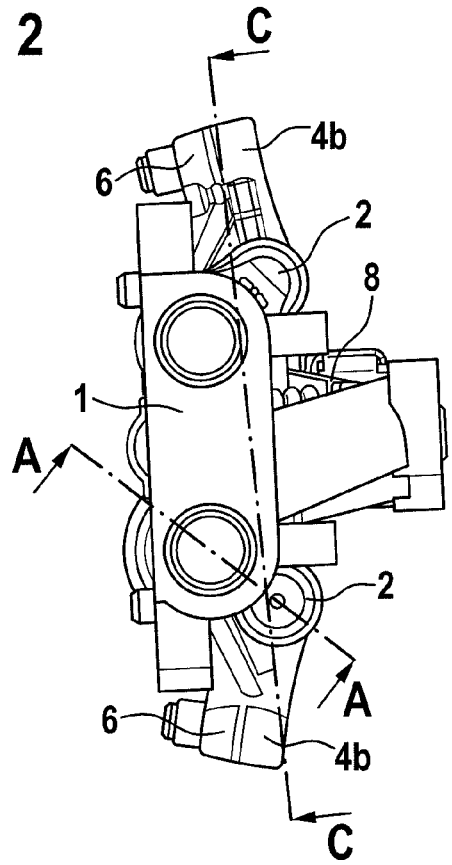
FIG. 2 is a side view of the device.
Figure 3:
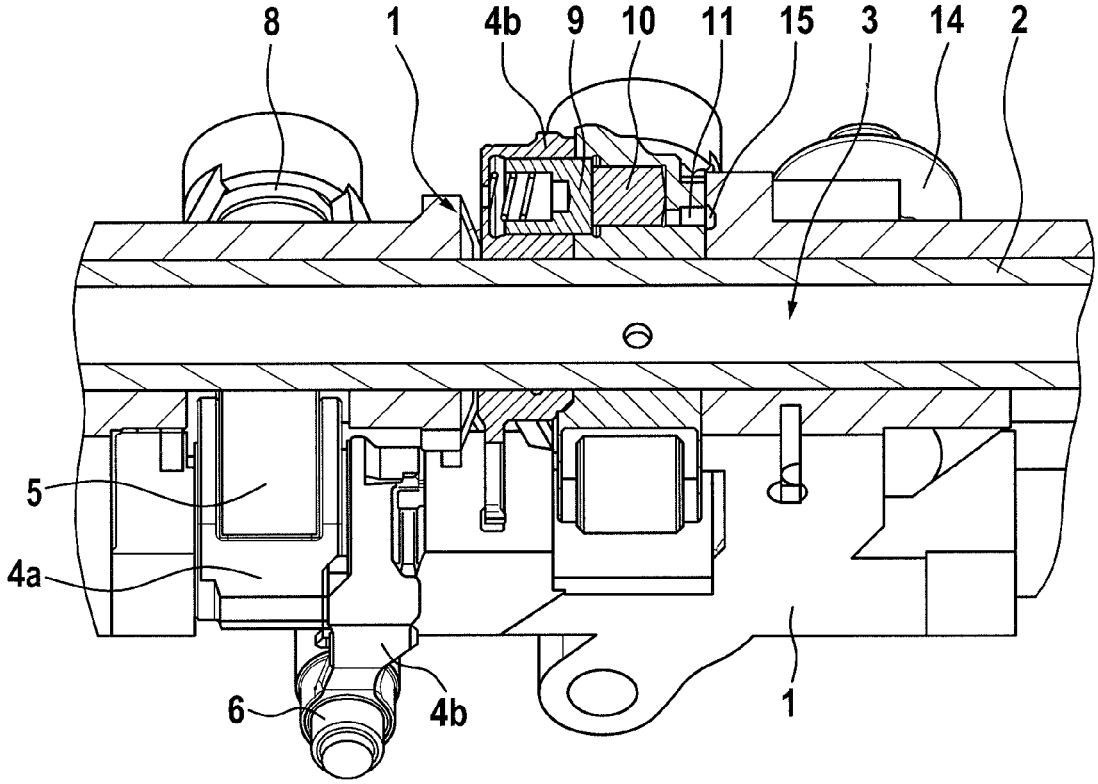
FIG. 3 is a section view through a part of the device according to line A-A in FIG. 2.
Figure 4:
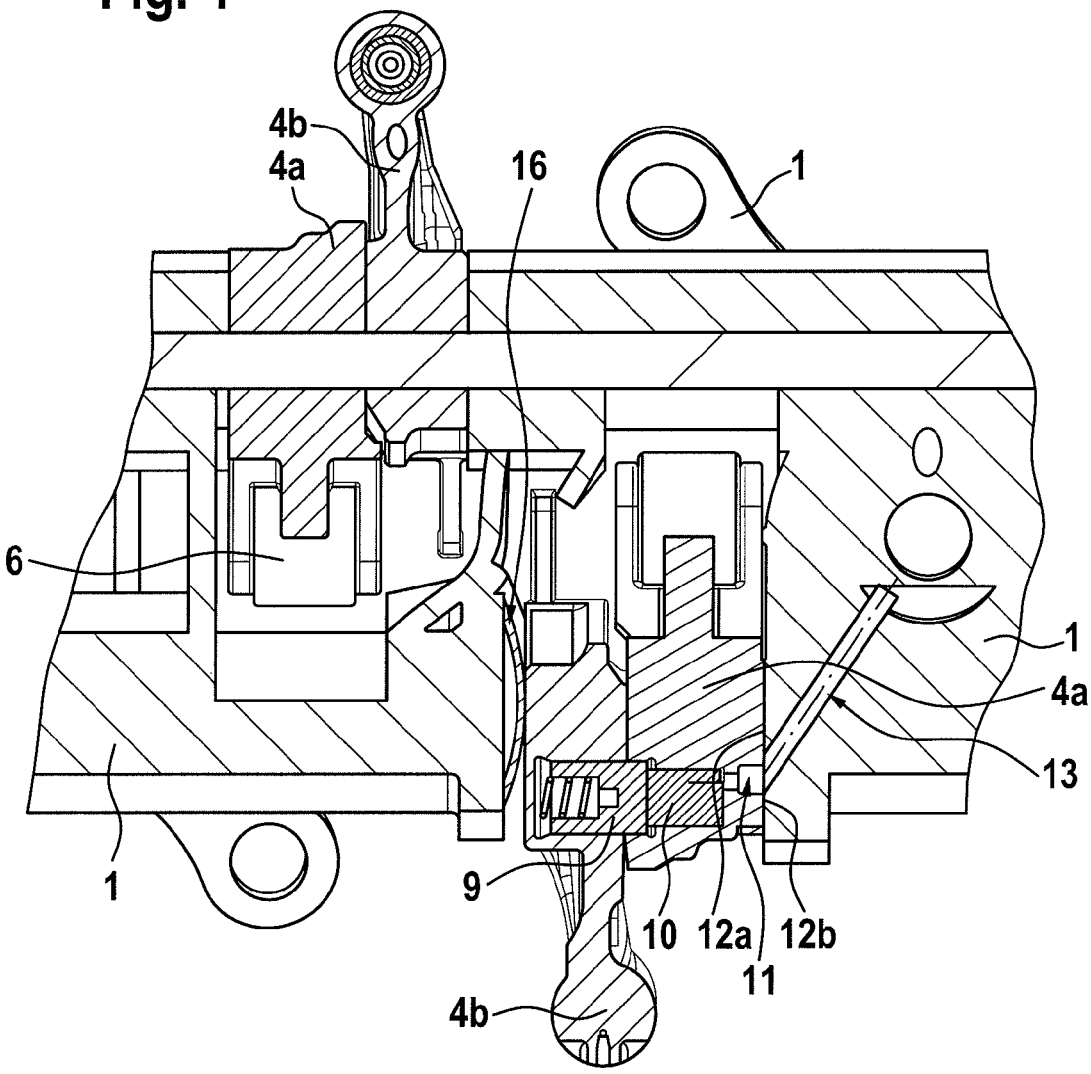
FIG. 4 is a section view through a part of the device according to line C-C in FIG. 2.

In FIGS. 1 to 5, as far as shown in detail, a carrier body is designated with 1 in which a hollow shaft designated with 2 is installed. The hollow shaft 2 has a central hollow space 3 to which lubricating oil is fed from the oil circuit of the internal combustion engine.

The device according to the invention has widened carrier bodies, so that two hollow shafts 2 are inserted into each of these bodies. Through a not-shown camshaft, gas-exchange valves that are spaced apart can be activated. The activation is performed by two valve activating levers 4*a* and 4*b* that are arranged one next to the other and that are supported individually on a hollow shaft. On its free end, one valve activating lever 4*a* has a roller 5 that is in active connection with the not-shown cam of the not-shown camshaft. The roller 5 is advantageously guided by an anti-friction bearing on the valve activating lever 4*a*.

On its free end, the valve activating lever 4*b* has a hydraulic valve lash compensation element 6 that is used for automatic adjustment of the valve lash. The valve activating lever 4*a* engages a compression spring that is designated with 8 and that is supported with its other end on the carrier body 1. As is to be taken, in particular, from FIGS. 3 and 4, a coupling pin 9 that is loaded by a spring in the direction of the valve activating lever 4*a* is supported in the valve activating lever 4*b*. In the valve activating lever 4*a*, in extension of the coupling pin, a recess is provided so that the coupling pin can project into this recess through the loading of the spring and thus causes a coupling of the valve activating levers 4*a* and 4*b* to each other.

In the valve activating lever 4*a*, a piston 10 is arranged that is supported in the extension of the coupling pin 9 and with its end face can shift the coupling pin against the force of the spring. With the valve activating lever 4*a* it forms a compression chamber to which a guide piece 11 is connected. In the guide piece 11, if a pressure is produced whose force is greater than the force of the spring on the coupling pin, then this is shifted back against the spring force and therefore the coupling between the two valve activating levers 4*a* and 4*b* is released. Then the pivoting motion is not transmitted from the valve activating lever 4*a* to the valve activating lever 4*b*, so that the associated gas-exchange valve is not opened. The guide piece 11 leads to a sliding surface 12*a* on the valve activating lever 4*a* that is in active connection with a sliding surface 12*b* on the carrier body 1. A channel 13 in the carrier body 1 that is controlled by an electromagnetically activated valve and that is designated with 14 is attached to the sliding surface 12*b*. Pressurized fluid that is made available by the internal combustion engine is continuously applied to the electromagnetically activated valve 14.

Figure 5:
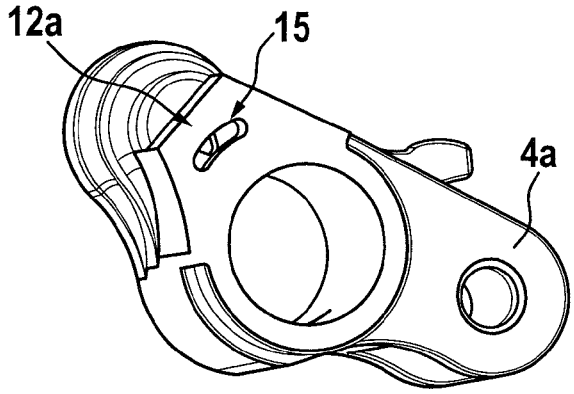
FIG. 5 is a perspective view of a valve activating lever.

In the perspective view of the valve activating lever 4*a* in FIG. 5, the sliding surface 12*a* is visible. In the sliding surface 12*a*, a kidney-shaped extension 15 is formed that has its longitudinal extent in the pivoting direction of the valve activating lever 4*a*. In this way it is guaranteed that, regardless of which pivoting position the valve activating lever 4*a* has, the guide piece 11 is always in active connection with the end of the channel 13 in the carrier body 1.

To generate sufficient tightness at the sliding surfaces, on the carrier body 1 a leaf spring designated with 16 is mounted (FIG. 4) that presses the valve activating lever 4*b* against the valve activating lever 4*a* and this against the carrier body 1.

LIST OF REFERENCE SYMBOLS

Carrier body
1 Hollow shaft
2 Hollow space
4*a* Valve activating lever
4*b* Valve activating lever
5 Roller
6 Hydraulic valve clearance compensation element
8 Compression spring
9 Coupling pin
10 Piston
11 Guide piece
12*a* Sliding surface
12*b* Sliding surface
13 Channel
14 Electromagnetically activated valve
15 Kidney-shaped extension
16 Leaf spring

The invention claimed is:

1. Device for coupling two valve activating levers of an internal combustion engine, comprising at least one carrier body mounted on the internal combustion engine, at least one hollow shaft in which oil of the reciprocating piston internal combustion engine is stored is mounted on the carrier body, a coupling pin that is supported parallel to the hollow shaft in first and second valve activating levers, that is spring loaded on one side and loaded by pressurized fluid on the other side such that the coupling pin connects or releases the first and second valve activating levers to each other, and at least one electromagnetically activated valve to control the pressurized fluid taken from an oil circuit of the internal combustion engine, and supply of the pressurized fluid to the coupling pin is provided via channels that are provided in the at least one carrier body of the internal combustion engine.

2. Device according to claim 1, wherein the at least one carrier body and the first valve activating levers in connection with the channel for the pressurized fluid form a transition region to which a guide part in the valve activating lever for the coupling pin is connected.

3. Device according to claim 2, wherein the transition region has contacting sliding surfaces on the at least one carrier body and on the first valve activating lever and the first valve activating lever is loaded in a direction toward the carrier body.

4. Device according to claim 3, wherein a kidney-shaped extension is provided in at least one of the sliding surfaces in connection with the openings of at least one of the channel or the guide piece.

5. Device according to claim 1, wherein the electromagnetically activated valve is arranged in the carrier body, with one of the electromagnetically activated valves provided for each of the channels.

6. Device according to claim 3, wherein a spring loads the first valve activating lever in the direction toward the carrier body.

7. Device according to claim 6, wherein the spring comprises a leaf spring arranged between the second valve activating lever and a wall of one the at least one carrier bodies, wherein the wall is adjacent to the lever.

* * * * *